US006832445B2

(12) United States Patent
Pitzen

(10) Patent No.: US 6,832,445 B2
(45) Date of Patent: Dec. 21, 2004

(54) GRAPHIC DISPLAY DEVICE MOUNTABLE WITH STRETCH RELEASING ADHESIVE

(75) Inventor: James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/335,558

(22) Filed: Dec. 31, 2002

(65) Prior Publication Data

US 2004/0123503 A1 Jul. 1, 2004

(51) Int. Cl.[7] ..... G09F 7/12; A47G 1/06
(52) U.S. Cl. ..... 40/594; 40/773
(58) Field of Search ..... 40/594, 611.01, 40/760, 768, 773, 638

(56) References Cited

U.S. PATENT DOCUMENTS

| | | | | |
|---|---|---|---|---|
| 3,885,768 | A | * 5/1975 | Frye | 248/549 |
| 3,953,933 | A | 5/1976 | Goldstein | |
| 4,094,490 | A | 6/1978 | Einhorn | |
| 4,244,512 | A | 1/1981 | Wise | |
| 4,275,518 | A | 6/1981 | Martin | |
| 4,310,978 | A | 1/1982 | Stern | |
| 4,478,384 | A | 10/1984 | Julseth | |
| 4,800,239 | A | 1/1989 | Hill | |
| 4,835,343 | A | 5/1989 | Graef et al. | |
| 4,907,771 | A | 3/1990 | Wang | |
| 4,915,316 | A | 4/1990 | Bastian | |
| 4,918,847 | A | 4/1990 | Lee | |
| 4,923,159 | A | 5/1990 | Wang et al. | |
| 5,121,896 | A | 6/1992 | Frye | |
| 5,180,886 | A | 1/1993 | Dierenbach et al. | |
| 5,224,078 | A | 6/1993 | Mallin | |
| 5,325,616 | A | 7/1994 | Valiulis | |
| 5,409,189 | A | 4/1995 | Lühmann | |
| 5,433,413 | A | 7/1995 | Adams | |
| 5,560,580 | A | 10/1996 | Almoslino | |
| 5,657,886 | A | 8/1997 | Tacchella | |
| 5,675,125 | A | 10/1997 | Hollinger | |
| 5,730,413 | A | 3/1998 | Chen | |
| 5,826,848 | A | 10/1998 | Cekosh | |
| D407,691 | S | 4/1999 | Barkan | |
| 5,921,514 | A | 7/1999 | Schumann | |
| 5,927,666 | A | 7/1999 | Barkan | |
| 5,972,455 | A | 10/1999 | Barry | |
| 5,984,247 | A | 11/1999 | Lühmann et al. | |
| 6,004,665 | A | 12/1999 | Lühmann et al. | |
| 6,026,605 | A | 2/2000 | Tippett | |
| 6,162,534 | A | * 12/2000 | Hamerski | 428/354 |
| 6,187,404 | B1 | 2/2001 | Schumann | |

FOREIGN PATENT DOCUMENTS

| | | |
|---|---|---|
| DE | 199 34 630 A1 | 2/2001 |
| EP | 0 861 622 A2 | 9/1998 |
| EP | 1 232 708 A1 | 8/2002 |
| WO | WO 94/21157 | 9/1994 |
| WO | WO 99/37729 | 7/1999 |
| WO | WO 03/070068 A1 | 8/2003 |

* cited by examiner

*Primary Examiner*—S. Joseph Morano
*Assistant Examiner*—Robert J. McCarry, Jr.
(74) *Attorney, Agent, or Firm*—David B. Patchett

(57) ABSTRACT

A graphic display device mountable with a stretch releasing adhesive includes a back plate, a double-sided stretch releasing adhesive tape having an adhesive portion adhered to the back plate rear surface and a non-adhesive pull tab projecting beyond the back plate, a graphic display member arranged adjacent to the back plate front surface, and a cover plate including a viewing area for viewing the graphic display member arranged adjacent to the graphic display member and connected with the back plate. When assembled, the display device conceals the non-adhesive pull tab but when the cover plate is separated from the back plate, the pull tab can be manually grasped by a user to stretch release the adhesive strip from the surface and the back plate.

14 Claims, 4 Drawing Sheets

GRAPHIC DISPLAY DEVICE MOUNTABLE WITH STRETCH RELEASING ADHESIVE

FIELD OF THE INVENTION

The present invention relates generally to decorative display items and, more particularly, to such a display device that is mounted with a stretch releasing adhesive tape having a non-adhesive pull tab that is concealed by the device.

BACKGROUND OF THE INVENTION

It is known to use stretch releasing adhesive tapes having non-adhesive pull tabs to mount items on a wall surface. U.S. Pat. No. 5,516,581 (Kreckel et al.), for example, discloses a removable adhesive tape that can be used to mount various items such as hooks, calendars, posters, and signs on a wall surface.

When using stretch releasing adhesive strips to mount an object on a wall surface, however, the non-adhesive pull tab at the end of a strip must either be left exposed to allow a user who later wishes to separate the objects to grasp it, or the mounted object must but be designed to selectively conceal and expose the pull tab to allow a user to access the pull tab during the stretch removal process. U.S. Pat. No. 5,507,464 (Hamerski et al.), for example, discloses a two-piece hook specially made with a slidable cover portion that selectively conceals the tab portion. U.S. Pat. Nos. 5,967, 474, 6,131,864, and 6,082,686 disclose holding devices of varying complexity that are adapted for mounting on a wall using a stretch releasing adhesive tape. Each holding device includes a base plate and a front functional part that covers the base plate and the non-adhesive pull tab that projects beyond the base plate.

German Patent publication DE 199 34 630 discloses a reusable frame for signs with a slot-like recess for holding a sign, a transparent front, an adapter with latching devices on the back, an adapter device removably attached to the adapter, and an adhesive film for attaching the device to a substrate, whereby a grip of the adhesive film extends beyond the adapter device that the grip is covered by the reusable frame attached to the adapter device.

There remains a need, however, for an improved device that can be mounted on a wall surface using a stretch releasing adhesive tape having a non-adhesive pull tab that includes means to conceal the pull tab when the article is mounted on a surface that is easy to make and use, and can be used to display interchangeable graphics.

It would therefore be desirable to provide a device that can be mounted on a wall surface using a stretch releasing adhesive tape having a non-adhesive pull tab that conceals the pull tab when the article is mounted on a surface which is easy to make and use and can be used to display interchangeable graphics.

SUMMARY OF THE INVENTION

The present invention provides a device that can be mounted on a substrate, such as a wall surface, using a stretch releasing adhesive tape having a non-adhesive pull tab that conceals the pull tab when the article is mounted on the surface. The device is easy to make and use and can be used to display graphics such as names tags, pictures, instructions, colored inserts, or seasonal decorations. To allow the graphics to be displayed, the device includes a viewing area through which the graphics are visible. For maximum flexibility, the device preferably allows the graphics to be readily interchanged depending on the circumstances.

In one embodiment, the present invention provides an article to be mounted on a surface including a back plate having front and rear major surfaces, a double-sided stretch releasing adhesive tape having an adhesive portion adhered to the back plate rear surface and a non-adhesive pull tab projecting beyond the back plate, a graphic display member arranged adjacent to the back plate front surface, and a cover plate arranged adjacent to the graphic display member and connected with the back plate, wherein the cover plate includes a viewing area for viewing the graphic display member. In this manner, when the cover plate is removed from the back plate, the pull tab is exposed and can be manually grasped by a user to stretch release the adhesive strip from the surface and the back plate.

The viewing area may be a transparent region of the cover plate or an opening in the cover plate. In one embodiment, the graphic display member is formed of a sheet of opaque material that is arranged in overlapping relation with the non-adhesive pull tab, so that the pull tab is concealed by the graphic display member. In another embodiment, the back plate contains a cutout and the non-adhesive pull tab is positioned adjacent to and is aligned within the cutout so that the pull tab is visible within the cutout and is accessible to a user to stretch release the adhesive strip when the cover plate is removed from the back plate. When an opaque graphic display member conceals the pull tab, the entire cover plate may be transparent.

In another embodiment, the cover plate includes an opaque portion and the viewing area is arranged adjacent to the graphic display member while the opaque portion of the cover plate is arranged in overlapping relation with the pull tab. In this manner, the pull tab is concealed by the opaque portion of the cover plate. The viewing area preferably comprises a central region of the cover plate and the opaque portion comprises a peripheral frame around the viewing area, and at least a portion of the opaque region is arranged in overlying relation with the pull tab, thereby to conceal the pull tab.

In other embodiments, the back plate contains a recess for receiving and supporting the graphic display member, and the cover plate includes a functional member, such as a hook, clip, or the like, extending outwardly from the cover plate. The cover plate may also contain an opening for receiving the base plate functional member, whereby the base plate functional member serves to support the cover plate.

In a specific embodiment, the present invention provides an article adapted for mounting on a surface that includes a back plate having front and rear major surfaces and a cutout, a double-sided stretch releasing adhesive tape having an adhesive portion adhered to the back plate rear surface and a non-adhesive pull tab projecting beyond the back plate adjacent to and in alignment with the cutout, a graphic display member formed of a sheet of opaque material arranged in overlapping relation with the non-adhesive pull tab, and a cover plate including a viewing area for viewing the graphic display member arranged adjacent to the graphic display member and connected with the back plate. In this manner, when the cover plate is removed, the pull tab is visible within the cutout and is accessible to a user to stretch release the adhesive strip.

In another specific embodiment, the present invention provides an article adapted for mounting on a surface that includes a back plate having front and rear major surfaces, a double-sided stretch releasing adhesive tape having an adhesive portion adhered to the back plate rear surface and a non-adhesive pull tab projecting beyond the back plate, a graphic display member arranged adjacent to the back plate front surface, and a cover plate arranged adjacent to the graphic display member and connected with the back plate, wherein the cover plate includes a viewing area for viewing the graphic display member and an opaque region arranged in overlapping relation with the pull tab, thereby to conceal the pull tab.

BRIEF DESCRIPTION OF THE DRAWING

The present invention will be further described with reference to the accompanying drawings, in which.

DETAILED DESCRIPTION

Figure 1:
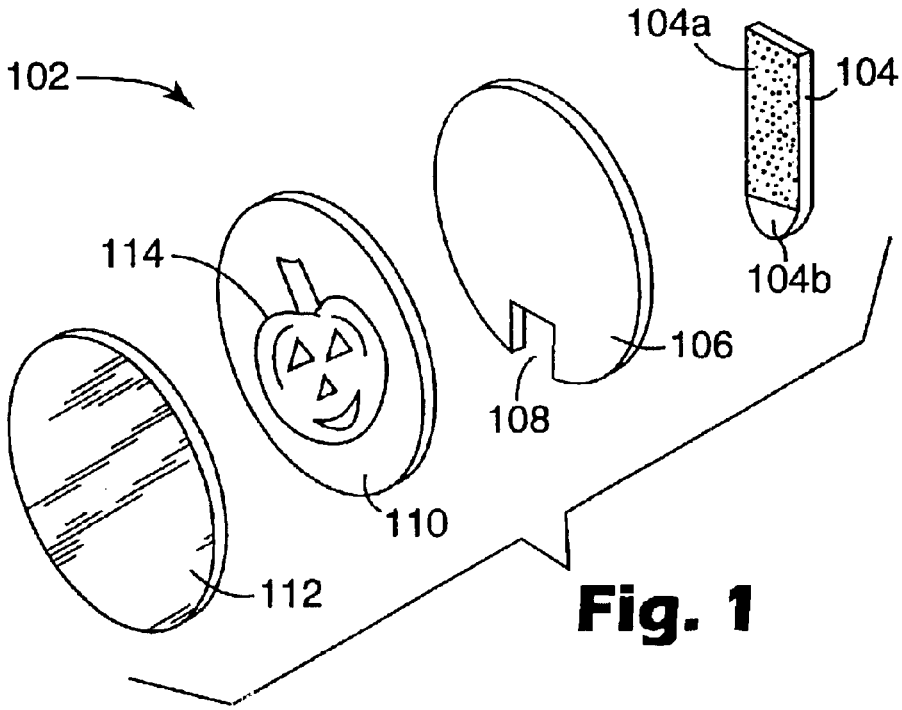
FIG. 1 is an exploded view of a graphic display device mountable with stretch releasing adhesive according to the invention.

Referring now to the drawings, wherein like or corresponding parts throughout the several views are referred to with like reference numerals incremented by 100, FIG. 1 shows a display device 102 including a double-sided stretch releasing adhesive tape 104 having an adhesive portion 104*a* and a non-adhesive pull tab 104*b*, a back plate 106 containing a cutout 108 arranged adjacent to the adhesive tape 104, an opaque graphic display member 110 arranged adjacent to the back plate 106 opposite the adhesive tape 104, and a transparent cover 112 arranged over the opaque graphic display member 110.

The adhesive tape 104 is provided to attach the display device 102 to a substrate such as a wall surface (not shown). When the display device 102 is mounted on such a surface, the adhesive tape 104 is adhered to the back plate 106 such that the non-adhesive pull tab 104*b* is aligned with and is arranged in the cutout 108. This allows a user to see the pull tab 104*b* when the cover 112 and graphic display member 110 are removed from the back plate 106, and also provides access to the pull tab 104*b* so a user can grasp and pull the pull tab 104*b* to effect removal of the display device 102 from a substrate at the desired time.

The graphic display member 110 is provided with an image 114 which may include words, graphical illustrations, pictures, or the like. The graphic display member 110 is opaque to conceal the pull tab 104*b* portion of the adhesive tape 104 that would otherwise be visible through the cutout 108 in the back plate 106.

The cover 112 is formed of a conventional clear or transparent material, such as glass or a synthetic plastic material, to allow the image 114 to be viewed. The cover 112 is attached to the back plate 106 by a friction fit, snap, threaded, or other conventional attachment mechanism to allow the cover 112 to be quickly and easily removed so that the display member 110 can be quickly and easily changed, and to provide easy access to the pull tab 104*b* when stretch removal of the display device 102 from an associated substrate is desired.

The adhesive strip 104 may be any conventionally known stretch releasing adhesive tape including a pressure sensitive adhesive tape with an elastic backing, a pressure sensitive adhesive tape with a highly extensible and substantially inelastic backing, or a solid, elastic pressure sensitive adhesive. Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. No. 5,516,581 (Kreckel et al.) and Bries et al. (U.S. Pat. No. 6,231,962); and the solid, elastic pressure sensitive adhesive described in German Patent No. 33 31 016.

Figure 2:
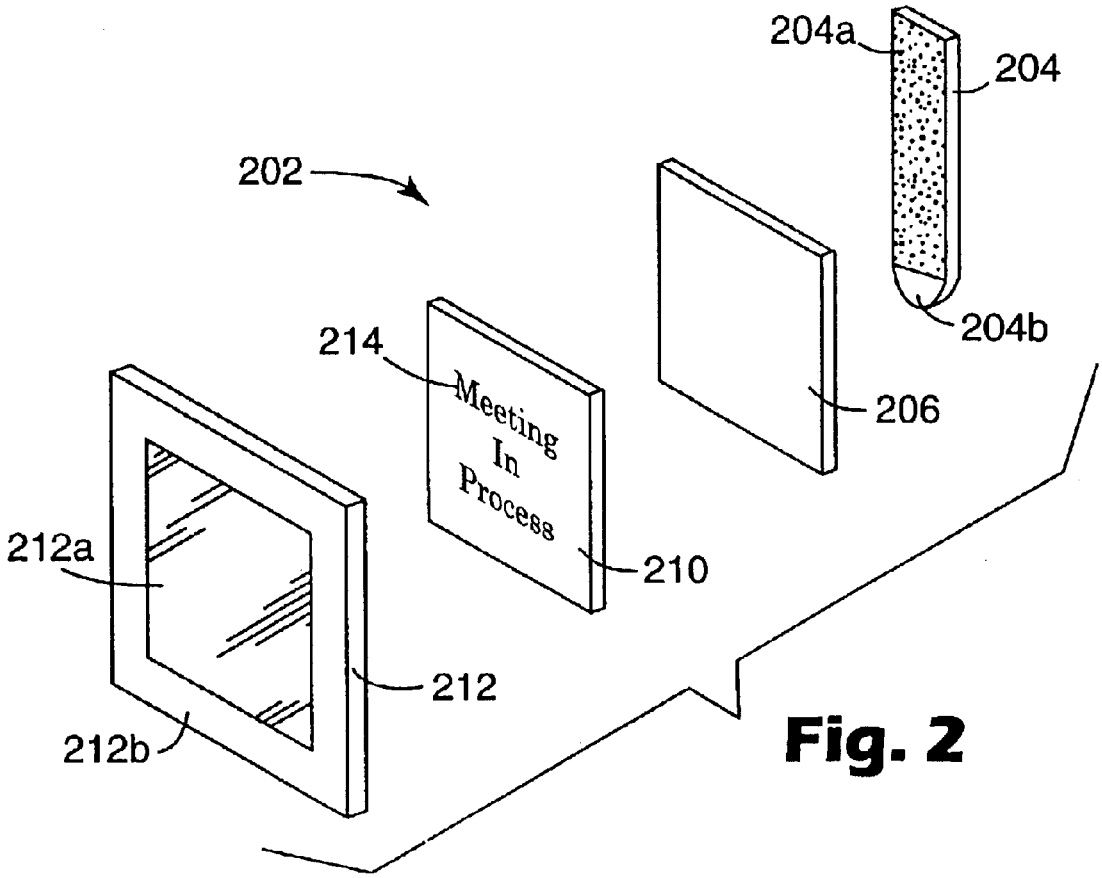
FIG. 2 is an exploded view of a second embodiment of the invention.

FIG. 2 shows a display device 202 including a double-sided stretch releasing adhesive tape 204 having an adhesive portion 204*a* and a non-adhesive pull tab 204*b*, a back plate 206 arranged adjacent to the adhesive tape 204, a graphic display member 210 arranged adjacent to the back plate 206, and a cover 212 arranged over the graphic display member 210. The adhesive tape 204 is adhered to the back plate 206 such that the pull tab 204*b* extends from behind the back plate 206, whereby it can be grasped and pulled by a user to effect stretch removal of the display device from a substrate. Thus, in contrast to the display device 102 of FIG. 1, the display device 202 does not contain a cutout.

The display member 210, which includes printed information 214, is arranged adjacent to and has the same outline (i.e. the same shape and surface area) as the back plate 206. It will be recognized that the display member 210 may also be smaller than the back plate 206. Because the display member 210 does not serve to conceal the pull tab 204*b*, it may be opaque or transparent. The cover 212 includes a transparent central viewing area 212*a* and an opaque peripheral region 212*b*. The viewing area 212*a* may be a clear or transparent material or may be an opening in the cover 212 that allows a user to view the printed information 214. The cover 212 includes a recess (not shown) adapted to receive the display member 210 and allows the cover 212 to be attached to the back plate 206.

To prevent the pull tab 204*b* from being visible through the viewing area 212*a*, the viewing area 212*a* does not extend beyond the perimeter of the back plate 206. The opaque peripheral region 212*b* extends around the viewing area 212*a* and extends beyond the perimeter of the display member 210 and back plate 206 to conceal the pull tab 204*b* that extends from behind the back plate 206. It will be recognized that in order for the opaque peripheral region 212*b* to effectively conceal the pull tab 204*b*, it need only extend beyond the display member 210 and back plate 206 in the region where the pull tab 204*b* protrudes and is visible from behind the display member 210 and back plate 206.

FIGS. 3*a*–3*d* show a display device 302 including a double-sided stretch releasing adhesive tape 304 having an adhesive portion 304*a* attached to a substrate 316 and a non-adhesive pull tab 304*b*, a back plate 306 adhered to the adhesive tape 304, a graphic display member 310 arranged adjacent to the back plate 306, and a cover 312 slidably connected with the back plate 306 and arranged over the graphic display member 310.

The adhesive portion 304*a* of the adhesive tape 304 is arranged between the back plate 306 and the substrate 316 and removably adheres the back plate 306 to the substrate 316, and thereby serves to secure the device 302 to the substrate 316. The non-adhesive pull tab 304*b* extends downwardly beyond the back plate 306 so that it can be grasped by a user to stretch remove and release the adhesive tape 304 from the back plate 306 and substrate 316.

Figure 3A:
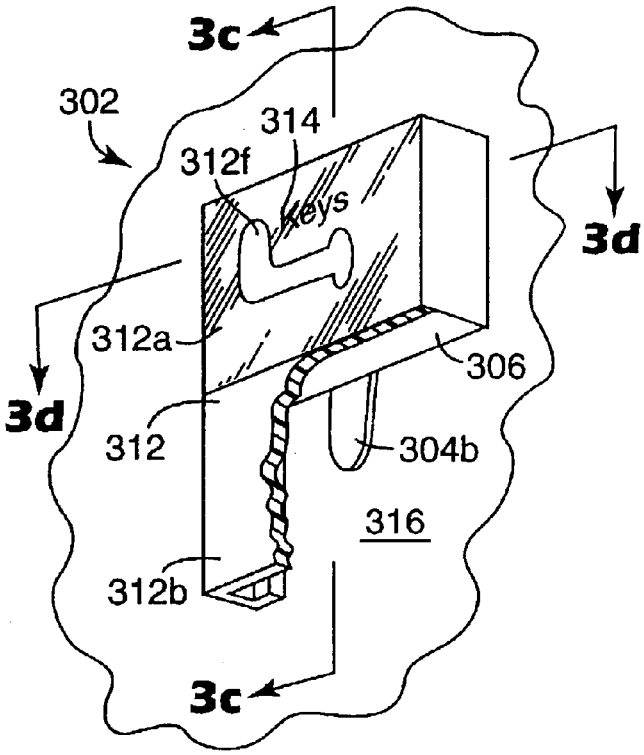
FIG. 3*a* is a perspective view of a third embodiment of the invention.
Figure 3B:
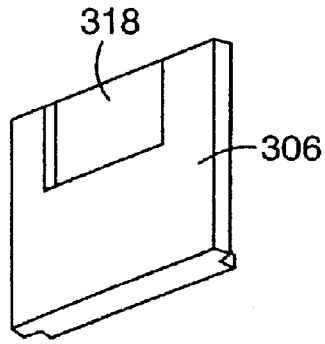
FIG. 3*b* is a perspective view of the back plate of FIG. 3*a;*
Figure 3C:
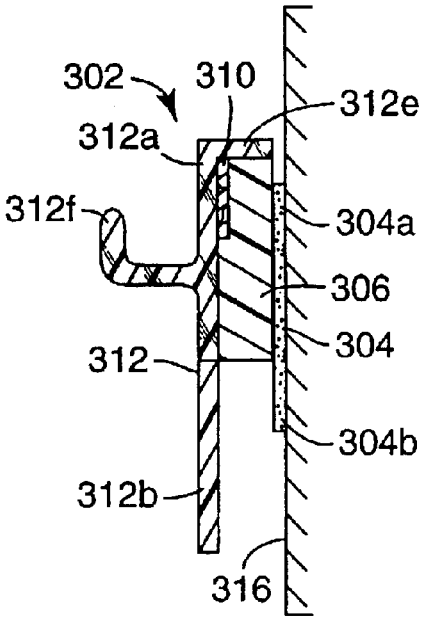
FIG. 3*c* is a sectional view taken along line 3*c*—3*c* of FIG. 3*a;*
Figure 3D:
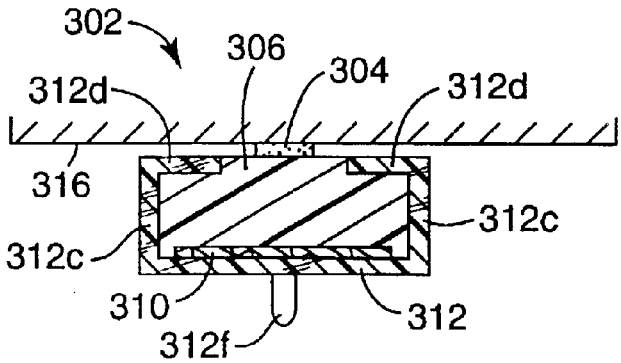
FIG. 3*d* is a sectional view taken along line 3*d*—3*d* of FIG. 3*a;*

As shown in FIG. 3*b*, the back plate 306 contains a recess 318 adapted to carry the graphic display member 310 in the back plate 306. The graphic display member 310 may be a sheet of paper or the like that can be quickly and easily replaced to provide flexibility and to allow the device to be personalized, be color coordinated with the surrounding décor, or customized, for example, to match the season. Thus, although the graphic display member 310 is shown with printing 314, it will be recognized that an endless variety of colors, patterns, printing, photographs, graphical illustrations, or other indicia may be provided on the graphic display member.

The cover 312 includes a transparent upper portion 312*a* that overlays the back plate 306 and the graphic display member 310 and allows the graphic display member 310 to be viewed, and an opaque bottom portion 312*b* that extends downwardly in overhanging relation with the pull tab 304*b*, thereby to conceal the pull tab.

The cover 312 includes side and rear portions 312*c* and 312*d* (FIG. 3*d*) that extend partially around the back plate 306 and thereby serve to prevent the cover plate 312 from moving either in the sideways direction with respect to the pack plate 306 or in the direction away from the substrate 316. The cover 312 further includes a top flange portion 312*e* (FIG. 3*c*) that extends over the top of the back plate 306 and rests on the top of the back plate 306 and thereby serves to vertically fix the cover 312 in place on the back plate 306. The cover also includes a functional portion 312*f* in the form of a hook extending outwardly from the face of the transparent top portion 312*a* of the cover. It will be recognized that other functional portions such as a clip may also be provided.

To access the pull tab 304*b* or replace the graphic display member 310, the cover 312 is removed by sliding it upwardly until it is completely separated from the back plate 306. Once the cover 312 is removed, the graphic display device 310 is easily accessed and the pull tab 304*b* can be grasped and pulled by a user to stretch remove the back plate 306 from the substrate 316.

Figure 4A:
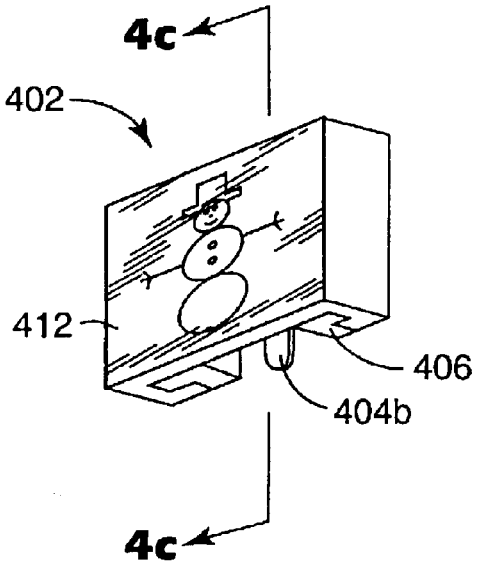
FIG. 4*a* is perspective view of a fourth embodiment of the invention.
Figure 4B:
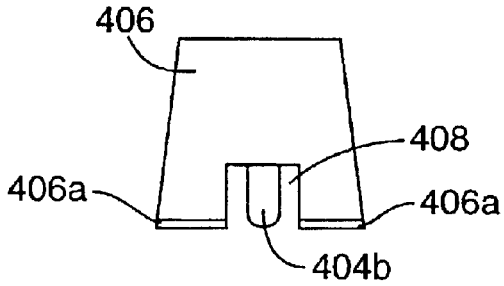
FIG. 4*b* is a front view of the device of FIG. 4*a* with the cover plate removed.
Figure 4C:
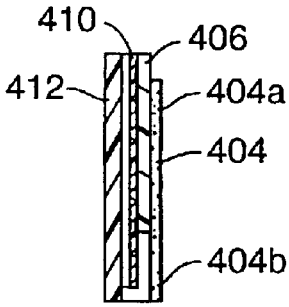
FIG. 4*c* is a sectional view taken along line 4*c*—4*c* of FIG. 4*a;*

FIGS. 4*a*–4*c* show a display device 402 including a double-sided stretch releasing adhesive tape 404 having an adhesive portion 404*a* and a non-adhesive pull tab 404*b*, a back plate 406 adhered to the adhesive tape 404, an opaque graphic display member 410 arranged adjacent to the back plate 406, and a transparent cover 412 slidably connected with the back plate 406 and arranged over the opaque graphic display member 410.

As shown in FIG. 4*b*, the back plate 406 contains a cutout 408 which is aligned with the adhesive tape pull tab 404*b* and provides access to the pull tab 404*b* when the cover 412 and graphic display member 410 are separated from the back plate 406, thereby allowing a user to grasp the pull tab 404*b* when stretch release of the display device 402 from an associated substrate is desired. The back plate 406 has a tapered or trapezoidal shape that fits into a similarly shaped cavity in the back of the cover 412, thereby to securely attach the cover 412 to the back plate 406.

The back plate 406 also includes a pair of protrusions 406*a* extending outwardly from the lower end of the back plate 406 that form a shelf for supporting the graphic display member 410. Because the graphic display member 410 is opaque, when the graphic display member 410 is arranged on the protrusions 406*a*, the pull tab 404*b* is concealed when viewed from the front.

Figure 5A:
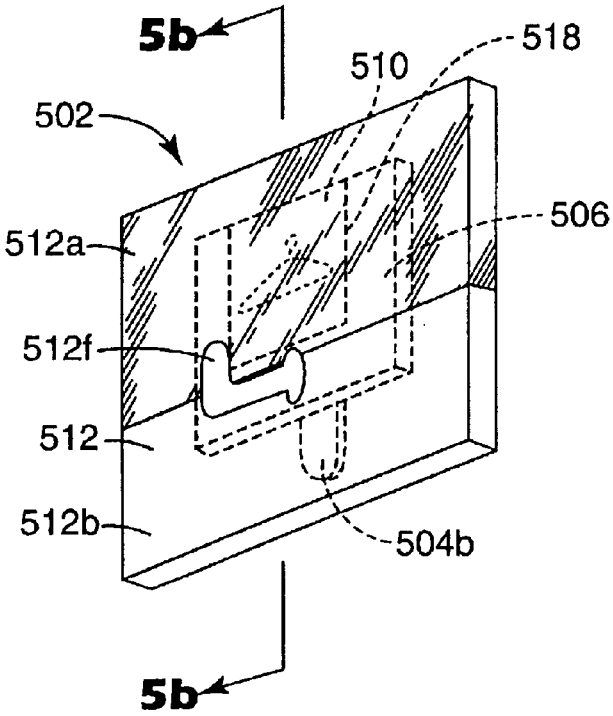
FIG. 5*a* is a perspective view of a fifth embodiment of the invention.
Figure 5B:
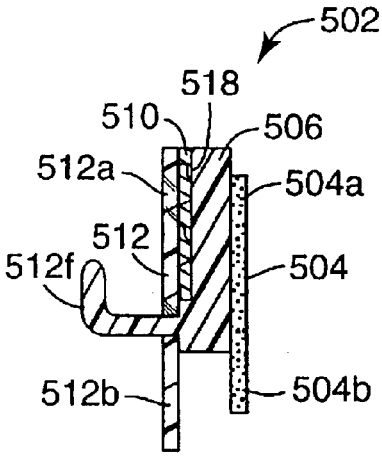
FIG. 5*b* is a sectional view taken along line 5*b*—5*b* of FIG. 5*a;*

FIGS. 5*a*–5*b* show a display device 502 including a double-sided stretch releasing adhesive tape 504 having an adhesive portion 504*a* and a non-adhesive pull tab 504*b*, a back plate 506 adhered to the adhesive tape 504, a graphic display member 510 arranged adjacent to the back plate 506, and a cover 512 connected with the back plate 506 and arranged over the graphic display member 510. The back plate 506 contains a recess 518 adapted to receive the graphic display member 510, and includes a hook portion 512*f* that supports the cover 512 when the cover is mounted on the back plate 506.

The cover 512 includes a transparent upper portion 512*a* that overlays the back plate 506 and the graphic display member 510 and allows the graphic display member 510 to be viewed, and an opaque bottom portion 512*b* that extends downwardly in overhanging relation with the pull tab 504*b*, thereby to conceal the pull tab 504*b* in a manner similar to that shown in FIG. 3.

Figure 6A:
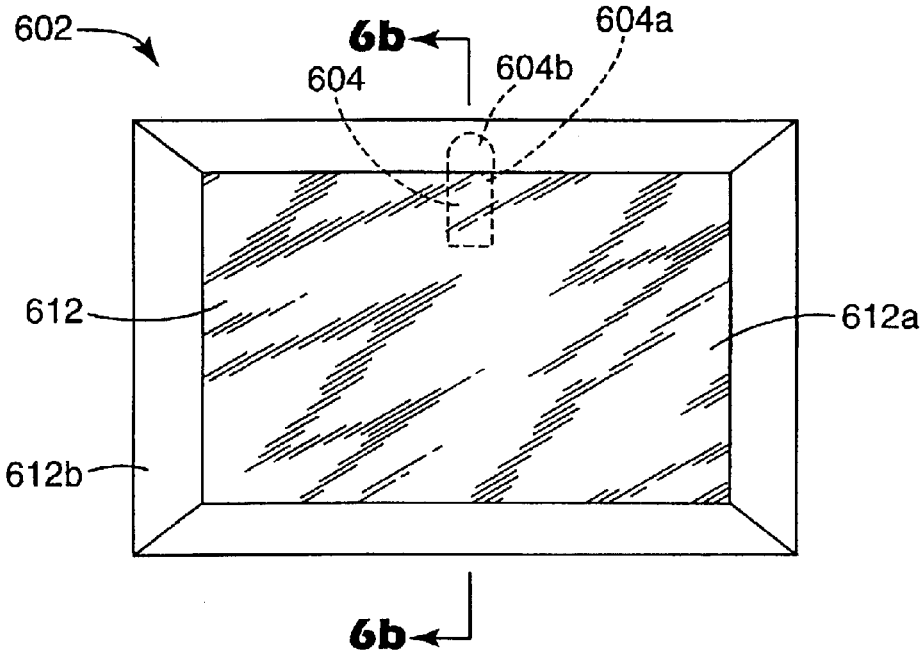
FIG. 6*a* is a front view of a sixth embodiment of the invention.
Figure 6B:
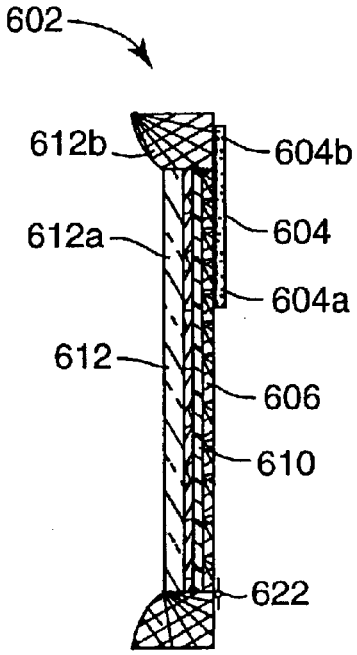
FIG. 6*b* is a sectional view taken along line 6*b*—6*b* of FIG. 6*a*.
Figure 6C:
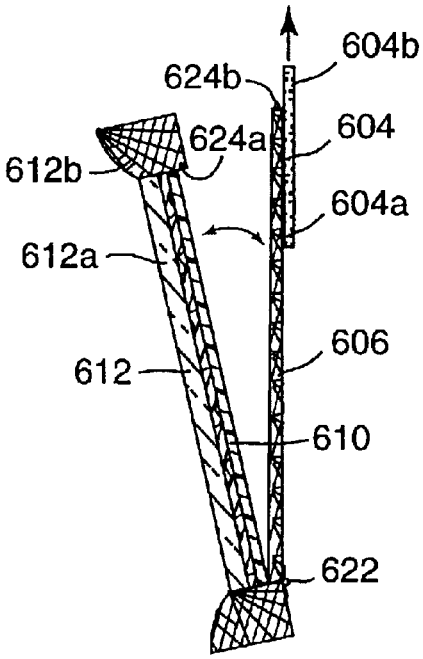
FIG. 6*c* is a sectional side view of FIG. 6*b* in its open condition.

FIGS. 6*a*–6*c* show a display device 602 having the appearance of a typical picture or photograph frame that includes a double-sided stretch releasing adhesive tape 604 having an adhesive portion 604*a* and a non-adhesive pull tab 604*b*, a back plate 606 adhered to the adhesive tape 604, a graphic display member 610 such as a photograph arranged adjacent to the back plate 606, and a cover 612 including a transparent central viewing area 612*a*, and an opaque frame 612*b* pivotally connected with the back plate 606 via hinge 622 and arranged over the graphic display member 610. The viewing area 612*a* may be a transparent material or an opening within the frame 612*b*.

The adhesive tape 604 is adhered to the back plate 606 such that the adhesive portion 604*a* is adhered to the back plate 606 and the non-adhesive pull tab 604*b* extends beyond the back plate 606 adjacent to the frame 612*b*. In this manner, the cover 612 serves to conceal the pull tab 604*b* when the display device 602 is assembled and mounted on a substrate, but allows the pull tab 604*b* to be easily accessed when the cover 612 is separated from the back plate 606, thereby allowing a user to grasp the pull tab 604*b* and stretch release the device from an associated substrate.

The base plate 606 is held in its closed position (FIG. 6*b*) by rotating the base plate 606 so that it is arranged adjacent to the viewing area 612*a* and arranged within the frame 612*b* and securing the base plate 606 in that position with mating snap connection 624*a* and 624*b* or other conventional means such as hook and loop fasteners. To remove the device, the snap connection 624*a* and 624*b* is separated to allow the cover 612 to pivot away from the base plate 606, thereby revealing the pull tab 604*b* which can then be grasped and pulled by a user to effect stretch removal of the device as described previously.

The complete disclosures of the patents, patent documents, and publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments set forth herein and that such embodiments are presented by way of example only with the scope of the invention intended to be limited only by the claims set forth herein as follows.

What is claimed is:

1. An article to be mounted on a surface, comprising:

(a) a back plate having front and rear major surfaces;

(b) a double-sided stretch releasing adhesive strip having an adhesive portion adhered to said back plate rear surface and a non-adhesive pull tab projecting beyond said back plate;

(c) a graphic display member arranged adjacent to said back plate front surface; and (d) a cover plate arranged adjacent to said graphic display member and connected with said back plate overlaying said graphic display member, said back plate and said non-adhesive pull tab, said cover plate including a viewing area for viewing said graphic display member;

wherein said cover plate is removable from said back plate to access said non-adhesive pull tab and thereby allow a user to manually grasp the pull tab and stretch release said adhesive strip from the surface and said back plate.

2. An article as defined in claim 1, wherein said viewing area is a transparent region of said cover plate.

3. An article as defined in claim 1, wherein said viewing area is an opening in said cover plate.

4. An article as defined in claim 1, wherein said graphic display member is formed of sheet of opaque material and is arranged in overlapping relation with said non-adhesive pull tab, whereby said pull tab is concealed by said graphic display member.

5. An article as defined in claim 4, wherein said back plate contains a cutout and said non-adhesive pull tab is positioned adjacent to and is aligned with said cutout, whereby said pull tab is visible within said cutout and is accessible to a user to stretch release said adhesive strip when said cover plate is removed from said back plate.

6. An article as defined in claim 5, wherein said cover plate is transparent.

7. An article as defined in claim 1, wherein said cover plate includes an opaque region, said viewing area being arranged adjacent to said graphic display member and said opaque region being arranged in overlapping relation with said pull tab, whereby said pull tab is concealed by said cover plate opaque region.

8. An article as defined in claim 7, wherein said viewing area comprises a central region of said cover plate and said opaque region comprises a peripheral frame around said viewing area, wherein at least a portion of said opaque region is arranged in overlying relation with said pull tab, thereby to conceal said pull tab.

9. An article as defined in claim 1, wherein said back plate contains a recess for receiving and supporting said graphic display member.

10. An article as defined in claim 1, wherein said cover plate includes a functional member extending outwardly from said cover plate.

11. An article as defined in claim 1, wherein said base plate includes a functional member extending outwardly from said base plate front surface and said cover plate contains an opening for receiving said base plate functional member, whereby said base plate functional member serves to support said cover plate.

12. An article as defined in claim 1, wherein said cover plate is pivotally connected with said back plate.

13. An article to be mounted on a surface, comprising:

(a) a back plate having front and rear major surfaces and containing a cutout;

(b) a double-sided stretch releasing adhesive strip having an adhesive portion adhered to said back plate rear surface and a non-adhesive pull tab projecting beyond said back plate aligned with said cutout;

(c) a graphic display member formed of a sheet of opaque material arranged adjacent to said back plate front surface in overlapping relation with said non-adhesive pull tab, whereby said pull tab is concealed by said graphic display member; and (d) a cover plate arranged adjacent to said graphic display member and removably connected with said back plate, said cover plate including a viewing area for viewing said graphic display member;

wherein when said cover plate is removed from said back plate, said pull tab can be manually grasped by a user to stretch release said adhesive strip from the marface and said back plate.

14. An article to be mounted on a surface, comprising:

(a) a back plate having front and rear major surfaces;

(b) a double-sided stretch releasing adhesive strip having an adhesive portion adhered to said back plate rear surface and a non-adhesive pull tab projecting beyond said back plate;

(c) a graphic display member arranged adjacent to said back plate front surface; and (d) a cover plate arranged adjacent to said graphic display member and connected with said back plate, said cover plate including an opaque region arranged in overlapping relation with said pull tab and a viewing area arranged adjacent to said graphic display member for viewing said graphic display member;

wherein when said cover plate is removed from said back plate, said pull tab can be manually grasped by a user to stretch release said adhesive strip from the surface and said back plate.

* * * * *

UNITED STATES PATENT AND TRADEMARK OFFICE

CERTIFICATE OF CORRECTION

PATENT NO. : 6,832,445 B2
DATED : December 21, 2004
INVENTOR(S) : Pitzen, James F.

It is certified that error appears in the above-identified patent and that said Letters Patent is hereby corrected as shown below:

Column 7,
Line 36, insert -- a -- before "sheet".

Column 8,
Line 36, delete "marface" and insert in place thereof -- surface --.

Signed and Sealed this

Fifth Day of April, 2005

JON W. DUDAS
*Director of the United States Patent and Trademark Office*